US006805143B2

(12) United States Patent
Yen et al.

(10) Patent No.: US 6,805,143 B2
(45) Date of Patent: Oct. 19, 2004

(54) PULL CORD MECHANISM FOR SELF-OPENING FOLDABLE UMBRELLA

(75) Inventors: Chiu-Chan Yen, Taipei (TW); Fu-Yi Chou, Taipei (TW)

(73) Assignee: Yo Fu Umbrella Co., Ltd., Taipei (TW)

( * ) Notice: Subject to any disclaimer, the term of this patent is extended or adjusted under 35 U.S.C. 154(b) by 22 days.

(21) Appl. No.: 10/300,636

(22) Filed: Nov. 21, 2002

(65) Prior Publication Data

US 2004/0099298 A1 May 27, 2004

(51) Int. Cl.[7] ..... A45B 25/16
(52) U.S. Cl. ..... 135/22; 135/24
(58) Field of Search ..... 135/22, 24, 20.3, 135/25.1, 25.4, 127, 38, 39

(56) References Cited

U.S. PATENT DOCUMENTS 5,029,596 A * 7/1991 Tung ..... 135/20.3
5,267,583 A * 12/1993 Wu ..... 135/24
5,390,686 A * 2/1995 Lin et al. ..... 135/24
5,441,065 A * 8/1995 Lin et al. ..... 135/24
6,016,822 A * 1/2000 Lin et al. ..... 135/24
6,415,805 B1 * 7/2002 Kuo ..... 135/22
6,626,197 B2 * 9/2003 Lin et al. ..... 135/24
2004/0020523 A1 * 2/2004 Lin et al. ..... 135/24

* cited by examiner

*Primary Examiner*—Ramon O. Ramirez
*Assistant Examiner*—Kofi Schulterbrandt
(74) *Attorney, Agent, or Firm*—Rosenberg, Klein & Lee

(57) ABSTRACT

A pull cord mechanism for a self-opening umbrella mainly comprises a core tube rest to support the first and second sheaves on one side. The core tube rest links the core tube at the lower end. Both core tube rest and core tube are housed in the hollow of the center shaft where the core tube rest comes on top. A cord retainer is installed at bottom of the center shaft. The lower shaft provides the third and fourth sheaves. The pull cord has one end tied to the cord retainer and the other end runs through the core tube, winding on the first sheave on the core tube rest, turning to the third sheave of the lower shaft, the second sheave on the core tube rest and down to the fourth sheave of the lower shaft and finally fastened to the top of the core tube rest to form a complete loop. The winding arrangement of pull cord enables to shrink the length of the center shaft and reduce the volume of the closed umbrella.

10 Claims, 5 Drawing Sheets

PULL CORD MECHANISM FOR SELF-OPENING FOLDABLE UMBRELLA

BACKGROUND OF THE INVENTION

1. Field of the Invention

This invention relates to a pull cord mechanism for self-opening umbrella, especially the type has five folds.

2. Description of the Prior Art

The umbrella has been one of indispensable tools in human daily life. Most people are fond of the foldable umbrella, because it is convenient to carry with in the folded form and is capable of keeping away both rain and sunshine effectively. The unique inconvenience is that the user has to withstand getting wet in the heavy rain while boarding on the cars or buses and closing the umbrella by hands.

For this weakness, a self-opening foldable umbrella has been invented, mainly comprising an upper sheave and a lower sheave fixed on the lower shaft with the pull cord winding on the sheaves. Because the pull cord is arranged very closely, when drawing the pull cord, a friction occurs which not only adversely affects the opening operation, but also shortens the life span of the pull cord.

For these defects noticeable on the prior art, an improvement is seriously required.

The inventor has dedicated great efforts for years to studying and improving these defects and come up with a novel pull cord mechanism as provided in this invention to eliminate the defects mentioned above.

SUMMARY OF THE INVENTION

The major object of this invention is to provide a shorter center shaft on which the pull cord mechanism for self-opening umbrella is mounted. Another object of this invention is to stagger the winding arrangement of the pull cord in an effort to evade the cord friction and make the self-opening at ease.

Another object of this invention is to determine the volume of the folded umbrella by means of the number of sheaves applied.

Another object of this invention is to provide a pull cord mechanism for the self-opening umbrella with simplified structure, pragmatic application and easy assembly.

To achieve the foregoing objects, the pull cord mechanism for the self-opening umbrella constitutes at least a core tube rest, a core tube, a plurality of sheaves, a lower shaft, a center shaft and a string of pull cord, in which center shaft contains several sections of short shaft for retractility. The core tube rest provides a rack to support perpendicularly the first and second sheaves. The core tube is fastened at the bottom of the core tube rest and links to the first sheave. The core tube rest sits on the top of the center shaft; the core tube stays in the hollow of the center shaft and a cord retainer perch at the bottom end of the center shaft. The lower shaft is sleeved on the center shaft which is allowed to slide up and down within the lower shaft. The third and fourth sheaves are arranged in parallel on the side of the lower shaft. One end of the pull cord is fixed on the core tube rest or the upper shaft, the other end of pull cord will go winding the first sheave, then passing the third sheave on the lower shaft, back to the second sheave on the core tube rest and finally coming to the fourth sheave on the lower shaft. The first and second sheaves are vertically arranged and the third and fourth sheaves are in parallel. This winding disposition always keeps the pull cord among the sheaves apart at a fixed clearance, so they will move smoothly with no entanglement and abrasion.

BRIEF DESCRIPTION OF THE DRAWINGS

The drawings disclose an illustrative embodiment of the present invention which serves to exemplify the various advantages and objects hereof and are as follows.

DETAIL DESCRIPTION OF THE PREFERRED EMBODIMENT

Figure 1A:
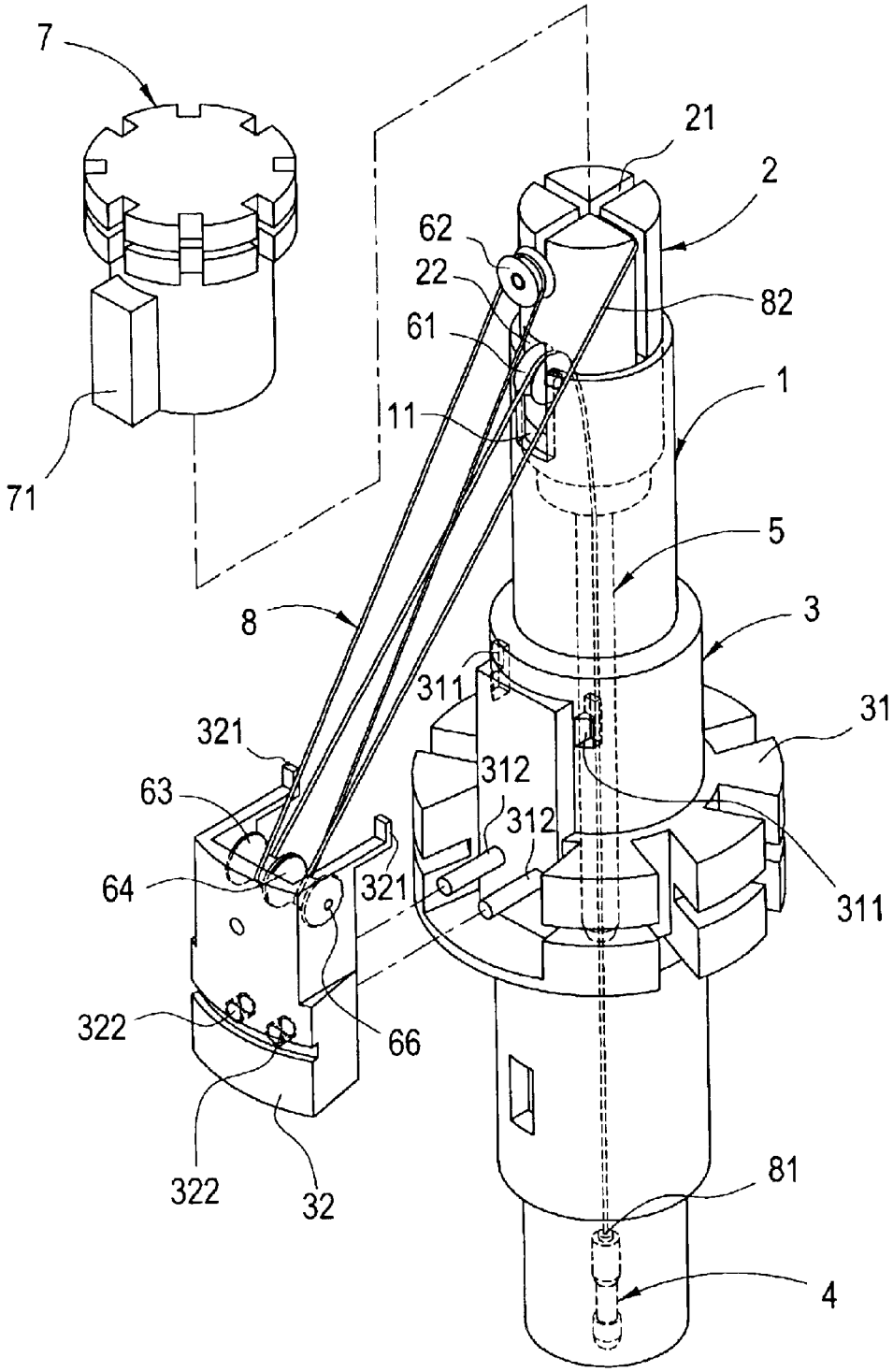
FIGS. 1A and 1B are schematic diagrams showing the complete assembly of the pull cord mechanism of this invention.
Figure 1B:
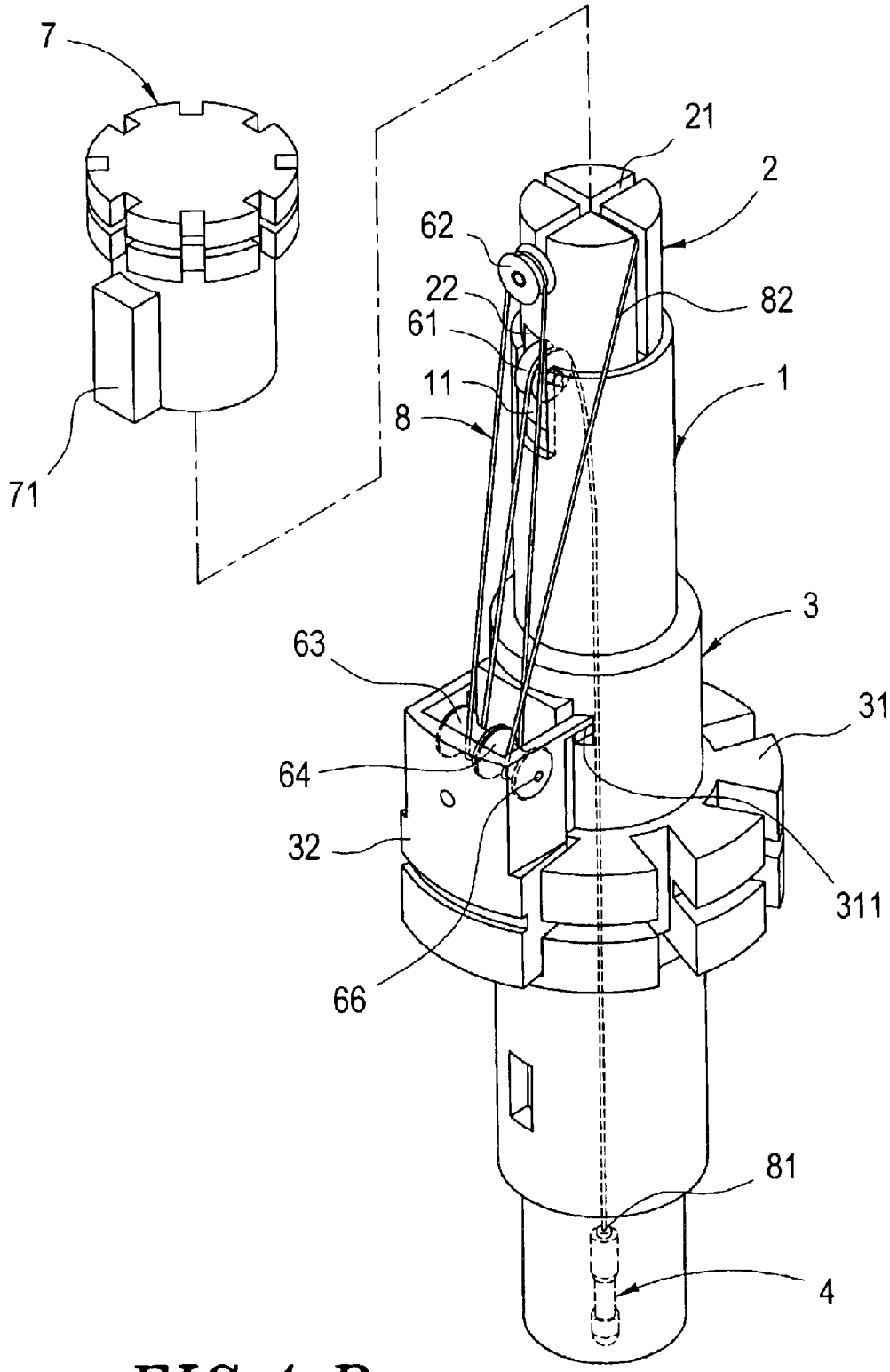

As shown in FIGS. 1A and 1B, the pull cord mechanism for the self-opening umbrella specified in this invention mainly comprises:

A center shaft 1 composed by several sections of short tubes, wherein one section of the tube is sleeved into other section of the tube for smooth retractility. The bottom of the center shaft 1 contains a cord retainer 4 and the tip has a slot 11.

A core tube rest 2 having a cross channel 21 opened on its top and a side channel 22. The bottom of the core tube rest 2 links to the core tube 5 through the side channel 22. The first sheave 61 and the second sheave 62 are vertically disposed on the side channel 22. The core tube rest 2 sits on the tip of the center shaft 1. The first sheave 61 exposes to the slot 11 of the center shaft 1. The upper shaft 7 is sleeved onto the center shaft 1. The upper shaft 7 has a side lid 71 to protect the second sheave 62 on the center shaft 1.

A lower shaft 3 containing a runner 31 and a cover 32. On one side of the runner 31, there are two adjacent snap holes 311 and two adjacent posts 312 below the snap holes 311. The top of the cover 32 forms a pair of lock tongues 321 bent in L shape, corresponding to and locked firmly in the snap holes 311. The third sheave 63 and fourth sheave 64 are mounted inside the cover 32. The third sheave 63 and the fourth sheave 64 are fastened by a connecting pin 66 in the cover 32. On the lower part, the cover 32 has two snap holes 322 for receiving the posts 312, so the cover 32 is firmly fastened to the side of the runner 31. The lower shaft 3 is sleeved on the center shaft 1, and the center shaft 1 will slide up and down inside the lower shaft 3.

A string of pull cord 8 with one cord end 81 tied to the cord retainer 4 at the bottom of the center shaft 1, the other cord end 82 passing the core tube 5, winding on the first sheave 61, directing to the third sheave 63 on the lower shaft 3, back to the second sheave 62 on the core tube rest 2, down to the fourth sheave 64 on the lower shaft 3 and finally being fastened on the core tube rest 2 or the upper shaft 7.

Figure 2:
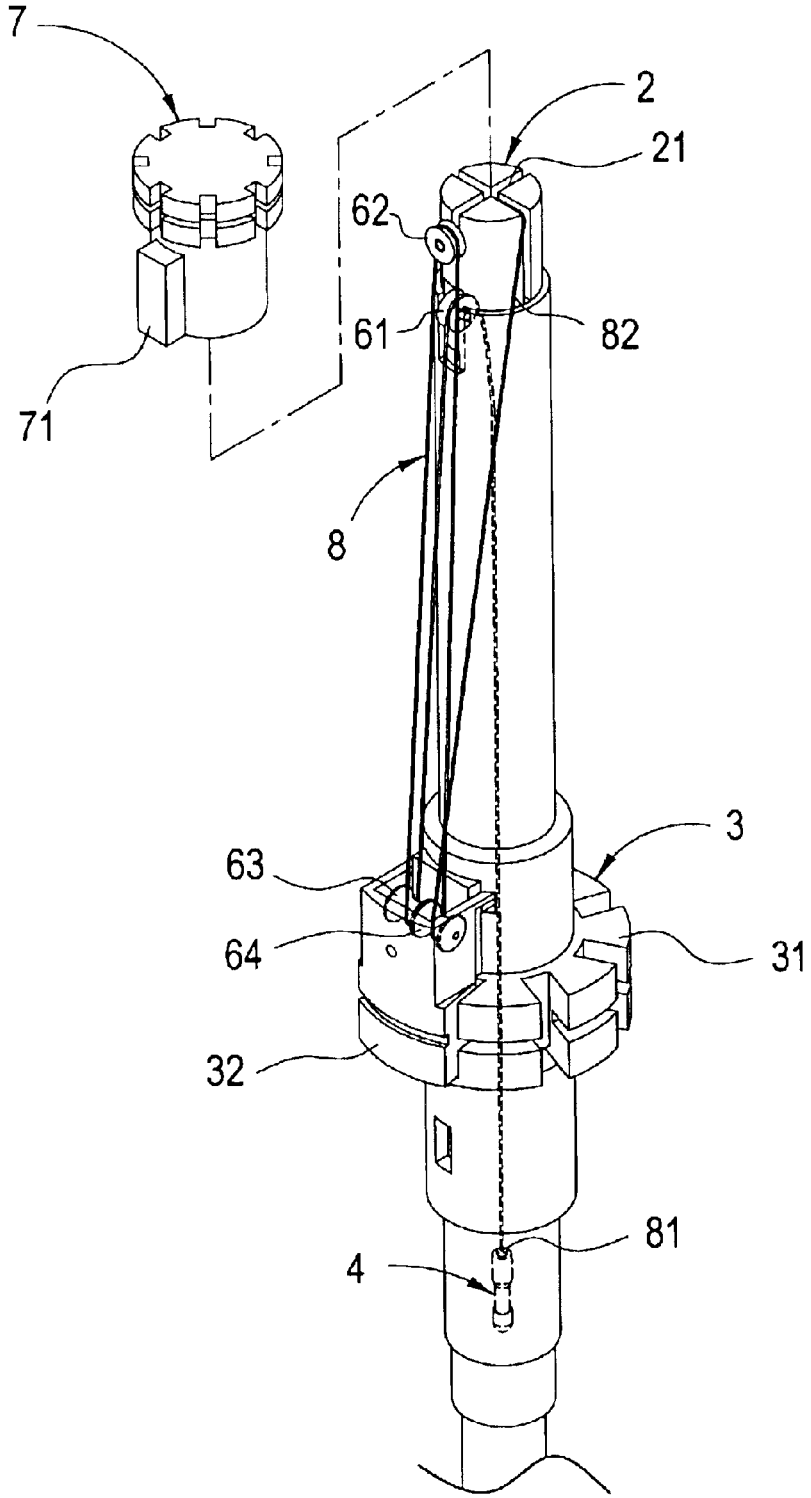
FIG. 2 is a schematic diagram showing the closing operation of the pull cord mechanism of a self-opening umbrella of this invention.
Figure 3:
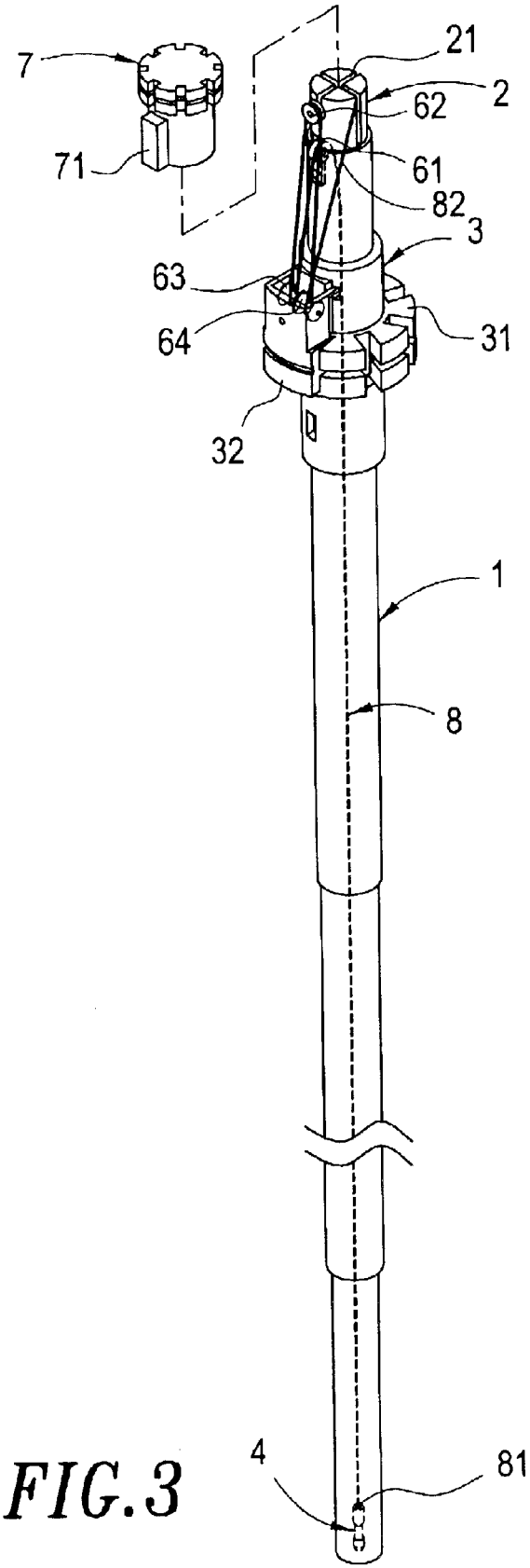
FIG. 3 is a schematic diagram showing the opening operation of the pull cord mechanism of a self-opening umbrella of this invention.

As shown in FIGS. 2 and 3, when the umbrella is in closed position (as illustrated in FIG. 2), the lower shaft 3 is locked in place in the handle (not shown). At this moment, the length ratio of the pull cord 8 between the inner center shaft 1 and the outer center shaft 1 is 4:1. When the center shaft 1 is retracted, the volume of the closed umbrella is therefore reduced in proportion. At the moment when the lower shaft 3 is released, the compressed spring will push the center shaft 1 extending upward as shown in FIG. 3 and the ribs are stretched to the full range to open the umbrella. At this moment, the cord retainer 4 still remains unmoved at the bottom of the center shaft 1, and the length ratio of the pull cord 8 between the inner center shaft 1 and the outer center shaft 1 becomes 1:4. When the cord retainer 4 is released, the pull cord 8 will pull up the center shaft 1 and reach the core tube 5, and the lower shaft 3 will move downward to a certain angle, the umbrella will be closed and the lower shaft 3 will be locked on the handle. This is the way how the umbrella is self-opened and closed.

Accordingly, the first sheave 61 and the second sheave 62 are vertically disposed on the core tube rest 2 and the third sheave 63 and the fourth sheave 64 are arranged in parallel on the lower shaft 3, so the pull cord 8 is so staggered to avoid entanglement and abrasion during opening and closing operation.

Figure 4:
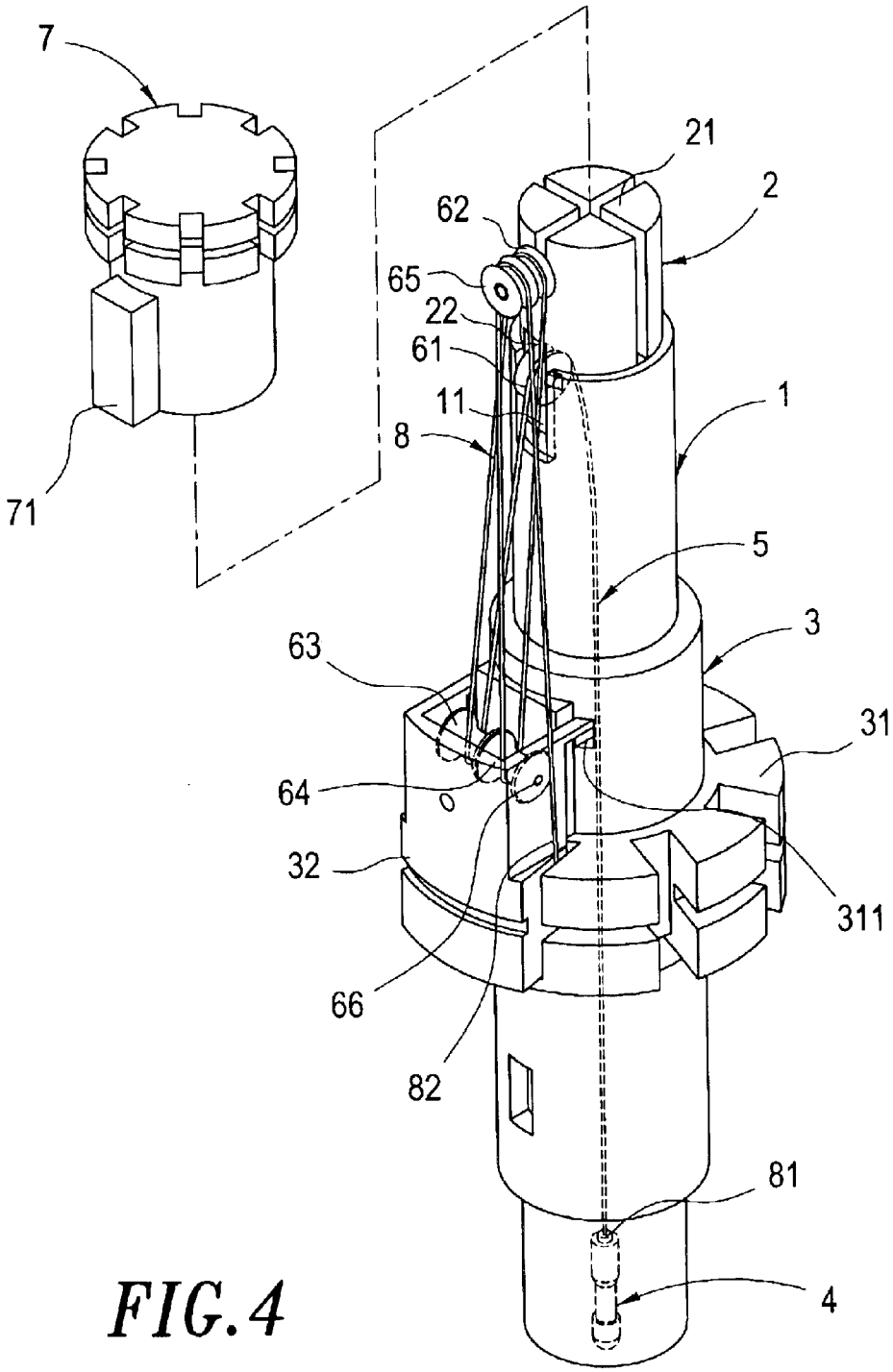
FIG. 4 is a schematic diagram showing another embodiment of the pull cord mechanism of a self-opening umbrella of this invention.

As shown in FIG. 4, there is a fifth sheave 65 overlapped on the second sheave 62 of the core tube rest 2. Such an arrangement will force the pull cord 8 passing the fourth sheave 64, winding on the fifth sheave 65 and finally tied to the lower shaft 3, and change the length ratio of the pull cord 8 to be 5:1 between the inner center shaft 1 and outer center shaft 1. The center shaft 1 is allowed to retract furthermore so the five sections of the foldable umbrella is made possible.

Comparing the prior art of foldable umbrella, the pull cord mechanism for the self-opening umbrella of this invention possesses the advantages as described below.

1. The center shaft is allowed to shorten appropriately in order to secure a smaller volume of the closed umbrella for easy carrying with or to elongate adequately in an attempt to gain more area of extended umbrella coverage.
2. The pull cord is in staggered arrangement to evade the entanglement and abrasion in opening and closing operation.
3. The numbers of sheave applied determine the size and volume of the closed umbrella.

Many changes and modifications in the above described embodiments of the invention can, of course, be carried out without departing from the scope thereof. Accordingly, to promote the progress in science and the useful arts, the invention is disclosed and intended to be limited only by the scope of the appended claims.

What is claimed is:

1. A pull cord mechanism for a self-opening foldable umbrella, comprising:

a slidably retractable center shaft, with a top and a bottom, having a side slot formed on said top and a cord retainer positioned centrally at said bottom;

an upper shaft;

a core tube rest with a first sheave and a second sheave both vertically disposed on a first side of said core tube rest so that the first sheave and the second sheave are positioned perpendicular to each other, a bottom end of said core rest connectedly juxtaposed with said core tube, said core tube being connected to said first sheave, with said core tube rest juxtaposedly positioned on top of said slidably retractable center shaft and said first sheave exposed within said side slot of said slidably retractable center shaft;

a lower shaft with a third sheave and a fourth sheave installed on said first side, said slidably retractable center shaft slidably inserted in said lower shaft;

a string of pull cord with a first cord end and a second cord end, wherein said first cord end is tied to said cord retainer at a bottom of said slidably retractbly center shaft and said second cord end is passed through said core tube, emerges from said slidably retractable center shaft, is wound around said first sheave and then advanced around said third sheave, then up and around said second sheave, back to a fourth sheave, and finally is fixedly secured to said core tube rest or to said upper shaft.

2. The pull cord mechanism for self-opening foldable umbrella of claim 1, wherein said slidably retractable center shaft comprises a plurality of sections of a tube, one sleeves other, permitting retractility therein.

3. The pull cord mechanism for self-opening foldable umbrella of claim 1, wherein said core tube rest has a cross channel formed on its top and a side channel for fastening one end of the pull cord and for supporting said first sheave.

4. The pull cord mechanism for self-opening foldable umbrella of claim 1, wherein said lower shaft contains a runner with a primary side and a cover with a top and lower part, said runner is provided with a pair of adjacent snap holes and a pair of adjacent posts on one side, wherein said top of said cover forms a pair of lock tongues, and said third sheave and fourth sheave are fastened by a connecting pin to said cover, wherein said lower part of said cover is formed with a pair of corresponding snap holes, and said pair at lock tongues are securedly positioned in said pair of snap holes of said runner and said pair of adjacent posts of said runner are securedly positioned in said pair of snap holes of said cover.

5. The pull cord mechanism for self-opening foldable umbrella of claim 1, wherein said upper shaft is sleevedly positioned on top of said center shaft and is formed with a side lid that is protectively positioned external to said second sheave.

6. The pull cord mechanism for self-opening foldable umbrella, comprising;

a slidably retractable center shaft, with a top and a bottom, having a side slot on said top and a cord retainer positioned centrally at said bottom;

an upper shaft;

a core tube rest with a first sheave and a second sheave both vertically disposed on a first side, a bottom end of said core tube rest connectedly juxtaposed with said core tube, said core tube being connected to said first sheave and juxtaposedly positioned on top of said slidably retractably center shaft wherein said first sheave is exposed within the side slot of said slidably retractable center shaft;

a lower shaft with a third sheave and a fourth sheave formed on said first side, said slidably retractable center shaft being slidably inserted in said lower shaft;

a string of pull cord with a first cord end and a second cord end, wherein said first cord end is tied to said cord retainer at a bottom of said slidably retractable center shaft and said second cord end is passed through said core tube, emerges out of said slidably retractable center shaft, is wound around said third sheave, then is passed up and around said second sheave, is passed back to said fourth sheave, and is fixedly secured to said core tube rest or to said upper shaft.

7. The pull cord mechanism for self-opening foldable umbrella of claim 6, wherein said upper shaft is sleeved on top of said slidably retractable center shaft having a side lid to cover said second and fifth sheaves.

8. The pull cord mechanism for self-opening foldable umbrella of claim 6, wherein said slidably retractable center shaft encompasses a plurality of reversibly telescoping coaxial sections of a tube.

9. The pull cord mechanism for self-opening foldable umbrella of claim 6, wherein said core tube rest has a plurality of cross channels formed on a top and a side channel wherein said second cord end of said pull cord is fixedly secured, and wherein is mounted said first sheave.

10. The pull cord mechanism for self-opening foldable umbrella of claim 6, wherein a lower shaft contains a runner and a cover, said runner formed with a pair of adjacent snap holes and a pair of adjacent posts on one side, and a top of said cover forms a pair of lock tongues, said third sheave and fourth sheave are fastened by a connecting pin to said cover, a lower part of said cover is drilled with two snap holes too, so two lock tongues of said cover are firmly locked in said snap holes of said runner and two posts of said runner are locked in said two snap boles of said cover.

* * * * *